United States Patent [19]

Kimpel

[11] 4,206,431

[45] Jun. 3, 1980

[54] MONOSTABLE ELECTROMAGNETIC ROTATING ARMATURE RELAY

[75] Inventor: Rolf-Dieter Kimpel, Tuerkenfeld, Fed. Rep. of Germany

[73] Assignee: Siemens Aktiengesellschaft, Berlin & Munich, Fed. Rep. of Germany

[21] Appl. No.: 957,555

[22] Filed: Nov. 3, 1978

[30] Foreign Application Priority Data

Nov. 9, 1977 [DE] Fed. Rep. of Germany ..... 2750142

[51] Int. Cl.[2] ..... H01H 51/22

[52] U.S. Cl. ..... 335/80; 335/84

[58] Field of Search ..... 335/78, 80, 81, 84, 335/85, 229, 230

[56] References Cited

U.S. PATENT DOCUMENTS

| | | | |
|---|---|---|---|
| 2,825,783 | 3/1958 | Sauer | 335/80 |
| 3,906,416 | 9/1975 | Sprando | 335/80 X |
| 3,993,971 | 11/1976 | Ono et al. | 335/78 X |
| 4,142,166 | 2/1979 | Arnoux | 335/81 |

*Primary Examiner*—George Harris

*Attorney, Agent, or Firm*—Hill, Van Santen, Steadman, Chiara & Simpson

[57] ABSTRACT

An electromagnetic relay provided with a rotating armature and two yoke arms, which form equally acting working air gaps, a monostable switching characteristic being achieved by means of respective additional pole pieces, whereby each yoke arm of the relay is disposed between a respective pole piece and a cooperable leg of the armature, at least one of the pole pieces being coupled to the armature over a permanent magnet.

13 Claims, 4 Drawing Figures

MONOSTABLE ELECTROMAGNETIC ROTATING ARMATURE RELAY

BACKGROUND OF THE INVENTION

The invention is directed to a monostable electromagnetic rotating armature relay in which two armature legs are connected by means of a ferromagnetic middle member, which armature is cooperable with two laterally opposed yoke arms of an excitation coil which are operative to form working air gaps between the armature legs and respective yoke arms.

Such relays are generally known, as for example German Utility Model No. 1,900,668. However, these known relays require additional external forces for effecting a resetting of the armature. If it is desired to utilize a symmetrical spring contact assembly, such resetting can be effected only by means of additional resetting springs. In addition, such a neutral magnet system is also relatively insensitive.

Further, it has also been proposed to make a polarized rotating armature system monostable, as for example illustrated in German AS No. 2,454,967 and corresponding U.S. Pat. No. 3,993,971. Such a relay utilizes a so-called H-armature having two parallel ferromagnetic bars and at least one intermediate permanent magnet. In order to achieve a monostable switching characteristic, it was proposed that the ferromagnetic bars be staggered by a certain portion of their length, whereby pole surfaces of different size are disposed opposite the pole pieces and armature bars. However, a monostable switching characteristic is still not assured merely by this arrangement. On the contrary, in this arrangement, a monostable characteristic must be induced by additional means, as for example unilaterally mounted separating members and auxiliary springs.

BRIEF SUMMARY OF THE INVENTION

The present invention therefore has as its objective, the design of a rotating armature of the general type described, which, as a result of a specific polarization of the armature, an unequivocal monostable switching characteristic is achieved without requiring additional resetting means.

This objective is inventively achieved by the construction of a relay, of the general type referred to, in which each of the two armature legs is provided with a pole piece extending parallel thereto, with the two being magnetically coupled together and forming an additional air gap in which is disposed the cooperable yoke arm of the excitation structure with at least one of the pole pieces being magnetically coupled to the cooperable parallel armature leg over a permanent magnet.

With such arrangement of the pole pieces on the armature, the two pole pieces lie essentially in series in the flux circuit of the cooperable permanent magnet or magnets. The armature thus assumes a rest position when the two pole pieces bear against the yoke arms, whereby the permanent flux circuit can be closed over the yoke.

Expediently, the armature is provided with two permanent magnets, whereby both pole pieces are respectively coupled over a corresponding permanent magnet to the associated parallel armature legs.

In this arrangement, the polarity of the permanent magnets is so selected that both are disposed in series relation over the middle portion or member of the armature connecting the two armature legs.

The magnetic asymmetry of such monostable relay is determined by means of their reluctance between the ferromagnetic middle portion or member of the armature and the two pole pieces. Consequently, the concept of the invention may also be realized when a ferromagnetic intermediate member is utilized instead of a continuous air gap between the pole pieces and the middle member, with the reluctance of such intermediate member thus guaranteeing a sufficient asymmetry of the flux forces. The coupling of the middle member to the two armature legs should be suitably selected and in this case various possibilities may be considered, from a ferromagnetic coupling to continuous air gaps. By suitable dimensioning of such reluctances, namely, in the middle member between the two armature legs, on the one hand, and between the respective pole pieces and such middle member, on the other hand, an optimum accommodation of the magnet system to the spring assembly can be attained.

In specific applications, it may be desirable to couple only one pole piece to the associated armature leg over a permanent magnet, with the other pole piece being ferromagnetically connected with the middle member or the cooperable armature leg. The location of the pivotal bearing of the armature also can be displaced from the center point between the two armature legs, whereby the lengths of the armature legs relative to the air gaps can be correspondingly varied.

BRIEF DESCRIPTION OF THE DRAWINGS

In the drawings wherein like reference characters indicate like or corresponding parts.

DETAILED DESCRIPTION OF PREFERRED EMBODIMENTS

Figure 1:
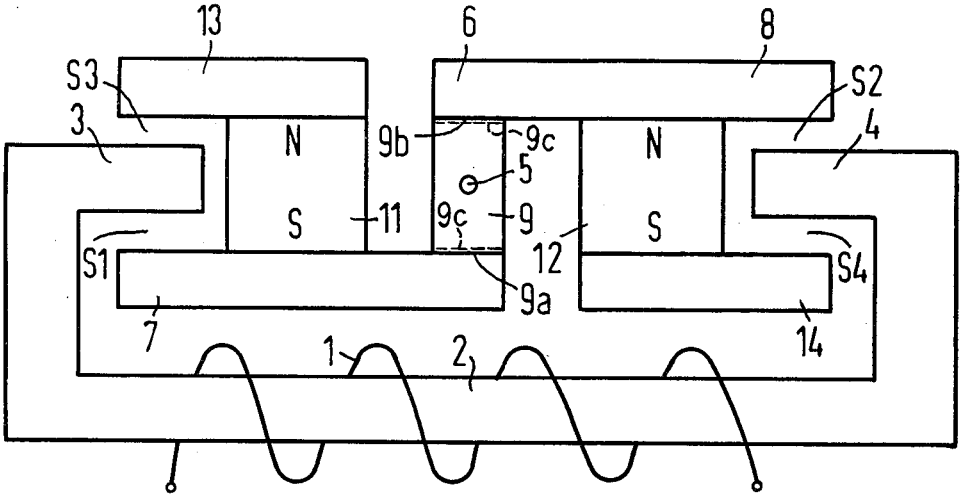
FIG. 1 is an elevational view of a magnet system for a monostable polarized rotating armature relay.
Figure 2:
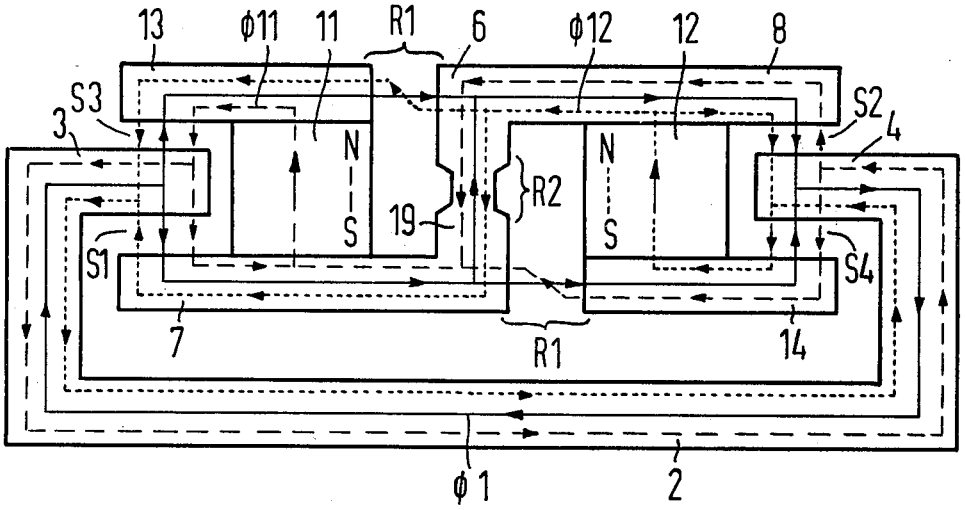
FIG. 2 is a similar view illustrating the flux pattern of the magnet system of FIG. 1.

Referring to FIG. 1, the magnet system for the monostable rotating armature relay illustrated, comprises an excitation coil 1 having a core 2 which forms two yoke arms 3 and 4, substantially aligned in spaced opposed relation. Centered between the ends of the yoke arms 3 and 4, and disposed on a rotational axis 5, is an armature 6. The armature 6 comprises two armature legs 7 and 8, which are disposed symmetrically to the rotational axis 5, and a ferromagnetic middle portion or member 9 which is magnetically connected in suitable manner, over the coupling surfaces **9*a* and 9*b*, to the respective armature legs 7 and 8. Depending upon the characteristics desired in the magnetic circuit, the armature legs 7 and 8 can, for example, be formed, along with the middle member 9, from a single piece of ferromagnetic material, as illustrated in FIG. 2. Likewise, in another case, the coupling surfaces 9*a* and 9*b* can be formed to provide air gaps, for example, by inserting a non-ferromagnetic foil 9*c* therebetween as indicated in dotted line in FIG. 1. The armature leg 7, and cooperable yoke arm 3, form a working air gap S1 while the armature leg 8 and cooperable yoke arm 4** form a corresponding working air gap S2. Thus, upon excitation of the coil 1, both armature legs 7 and 8 are attracted to the cooperable yoke arms 3 and 4.

Resetting of the armature, it is effected by two permanent magnets 11 and 12, respectively carried by the armature legs 7 or 8 which also carry respective pole pieces 13 or 14, with each of the pole pieces being disposed in sapced parallel arrangement relative to the cooperable armature leg. Each yoke arm 3 or 4 is disposed between a respective pole piece and cooperable armature leg. The pole piece 13 and the yoke leg 3 thus form an additional air gap S3, while the pole piece 14 and the cooperable yoke arm 4 form an additional air gap S4. The two permanent magnets 11 and 12 are so polarized that they are disposed magnetically in series over the middle member 9 of the armature 6.

Figure 4:
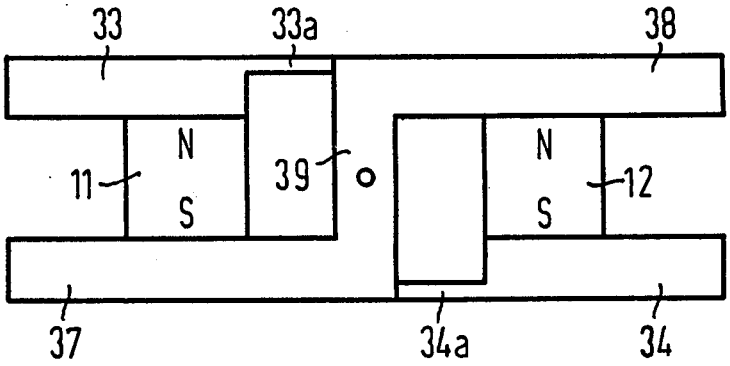
FIG. 4 is an elevational view, similar to FIG. 1 illustrating a modification thereof.

FIG. 2 illustrates the flux pattern and the super imposition of the excitation flux and the flux of the respective permanent magnets of a magnet system such as illustrated in FIG. 4. Thus, $\phi$ 1 designates the excitation flux generated by the excitation coil 1 and is indicated as a continuous line. $\phi$ 11, indicated as a broken line, designates the permanent flux generated by the permanent magnet 11, while $\phi$ 12, indicated by a dotted line, designates the permanent flux generated by permanent magnet 12.

As will be apparent from FIG. 2, the asymmetry of the magnet system results in the distribution of the permanent flux, continuously present in the air gaps at the rest side, i.e. at the air gaps S3 and S4, which is greater than the corresponding flux at the air gaps S1 and S2 of the working side of the armature. Thus, the two partial fluxes $\phi$ 11 and $\phi$ 12 of the permanent magnets are cumulative at the rest side but are in opposition or subtractive at the working side.

The magnetic reluctances R1 between the middle member 19 of the armature and the pole pieces 13 or 14, respectively, determine such asymmetry. Together with the reluctance R2 in the symmetry zone, i.e. at or around the axis 5 of the middle member 19, and the magnetization states of the magnets 11 and 12, the reluctances R1 are to be so dimensioned that an optimum accommodation or matching to the contact spring assemblies is achieved. In this connection, the reluctances R1 and R2 may be of a dimension suitable for the use of air gaps as well as for ferromagnetic cross sections.

By suitable variation of the reluctances R1 and R2, all intermediate stages between a monostable magnet system and a bistable magnet system can be produced. The latter extreme condition, at which the middle member 19 is split and united with the pole pieces, thus generally corresponds to the known H-armature of a bistable pole system and consequently is not the subject matter of the present invention.

Figure 3:
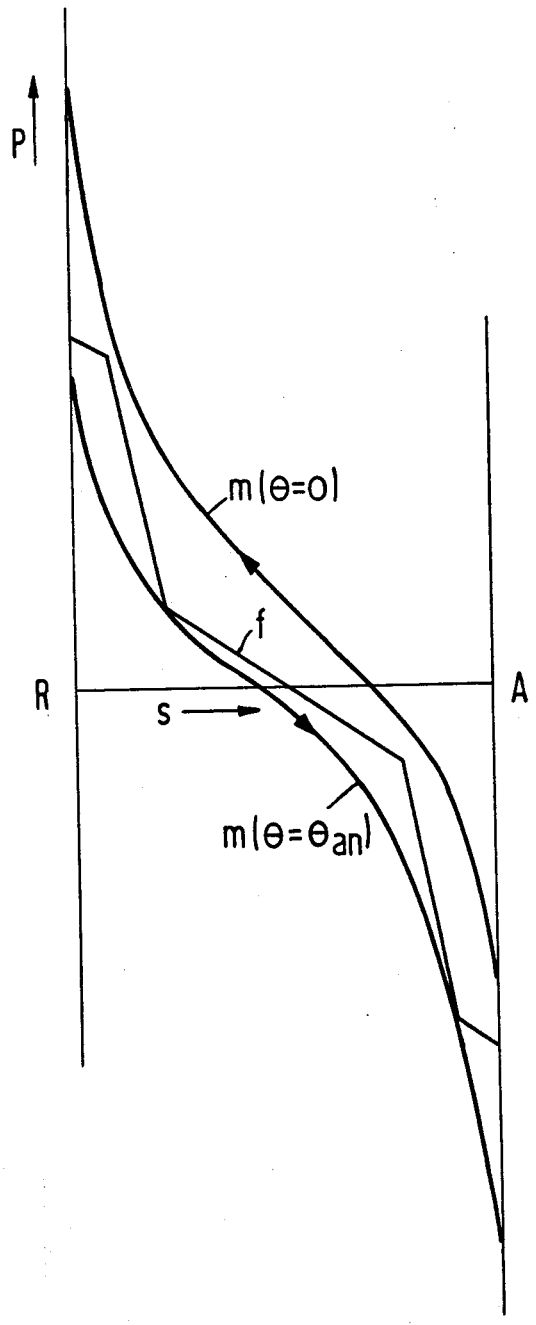
FIG. 3 is a diagram illustrating the force-path-characteristic of a relay employing the magnet system of FIG. 1.

FIG. 3 illustrates the force-path-characteristic of the magnet system illustrated in FIGS. 1 and 2, in which the force P is plotted over the path s, with the magnet system curves being designated by m and the spring assembly curve designated by f. The spring assembly should be so constructed that it is completely symmetrical, whereby the curve f, passes through the zero point exactly in the middle between the rest side R and the working side A. As long as no excitation is produced by means of the coil, the magnet system curve m ($\theta=0$) is applicable. The magnetic force curve thus lies above that of the spring assembly and the magnet system pulls the armature to the rest side R. When the magnet system is energized, the curve m ($\theta=\theta_{an}$) is applicable. In this case the magnet system curve lies below that of the spring assembly curve f and the armature is drawn to the working side A.

FIG. 4 illustrates a further embodiment of the invention in which the two armature branches 37 and 38 are ferromagnetically coupled over the middle piece 39. In a departure from the preceding examples, the pole pieces 33 and 34 are, in this construction, also respectively coupled to the middle piece 39 over respective narrow, ferromagnetic bars 33*a* or 34*a*. The monostable characteristic of the relay here results from the fact that the magnetic resistance of the bars 33*a* and 34*a* is, in each case, significantly greater than the magnetic resistance of the middle piece 39. The path of the permanent magnetic flux is therefore, in any given case, significantly more favorable in the one switching position than in the other, whereby the monostable characteristic always exists.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A monostable electromagnetic rotating armature relay, comprising an excitation coil having two laterally opposed yoke arms, an armature having two armature legs connected by means of a ferromagnetic middle member, each of which legs is cooperable with a respective yoke arm to form a working air gap, a pair of pole pieces, each disposed in spaced parallel relation to a corresponding armature leg, each pole piece being magnetically coupled with the corresponding armature leg and cooperable with the adjacent yoke arm to form a further air gap, with such yoke arm being disposed between the associated armature leg and pole piece, and permanent magnet means forming the magnetic coupling between at least one armature leg and the cooperable pole piece.

2. A rotating armature relay according to claim 1, wherein said permanent magnet means comprises respective permanent magnets, each connecting a respective pole piece with the associated parallel armature leg, whereby the two permanent magnets are disposed in series relation over the middle member of the armature.

3. A rotating armature relay according to claim 1, wherein one of the two pole pieces if ferromagnetically connected to the armature.

4. A rotating armature relay according to claim 1, wherein the armature legs and the middle member are in the form of a single integral structure.

5. A rotating armature relay according to one of the claim 1, wherein the armature legs are separated from the middle member by air gaps.

6. A rotating armature relay according to one of the claim 1, wherein the pole pieces are coupled with the middle member over ferromagnetic bars.

7. A rotating armature relay according to one of the claim 1, wherein the pole pieces are separated from the middle member over air gaps.

8. A rotating armature relay according to claim 2, wherein the pole pieces are coupled with the middle member over ferromagnetic bars.

9. A rotating armature relay according to claim 2, wherein the pole pieces are separated from the middle member over air gaps.

10. A rotating armature relay according to claim 4, wherein the pole pieces are coupled with the middle member over ferromagnetic bars.

11. A rotating armature relay according to claim 4, wherein the pole pieces are separated from the middle member over air gaps.

12. A rotating armature relay according to claim 5, wherein the pole pieces are coupled with the middle member over ferromagnetic bars.

13. A rotating armature relay according to claim 5, wherein the pole pieces are separated from the middle member over air gaps.

* * * * *